US010045558B2

(12) United States Patent
Henley et al.

(10) Patent No.: US 10,045,558 B2
(45) Date of Patent: Aug. 14, 2018

(54) METHOD AND APPARATUS FOR INSERTING ORIENTED OBJECTS INTO A FILTER ROD

(71) Applicant: Hauni Maschinenbau GmbH, Hamburg (DE)

(72) Inventors: Shawn Henley, Mechanicsville, VA (US); Scott Karpen, Henrico, VA (US); David Alan Pitt, Mechanicsville, VA (US); Erik P. Blix, Richmond, VA (US)

(73) Assignee: Hauni Maschinenbau GmbH, Hamburg (DE)

( * ) Notice: Subject to any disclaimer, the term of this patent is extended or adjusted under 35 U.S.C. 154(b) by 666 days.

(21) Appl. No.: 14/620,713

(22) Filed: Feb. 12, 2015

(65) Prior Publication Data

US 2016/0235113 A1 Aug. 18, 2016

(51) Int. Cl.

| | |
|---|---|
| ***A24C 5/32*** | (2006.01) |
| ***A24C 5/00*** | (2006.01) |
| ***A24C 5/02*** | (2006.01) |
| ***A24D 3/02*** | (2006.01) |
| ***A24D 3/06*** | (2006.01) |

(52) U.S. Cl.

CPC ..... *A24C 5/32* (2013.01); *A24C 5/002* (2013.01); *A24C 5/02* (2013.01); *A24D 3/025* (2013.01); *A24D 3/0216* (2013.01); *A24D 3/0287* (2013.01); *A24D 3/061* (2013.01); *A24D 3/063* (2013.01)

(58) Field of Classification Search

CPC ..... A24C 5/02; A24C 5/0002; A24C 5/32; A24C 5/002; B65B 19/04; A24D 3/025; A24D 3/0266

See application file for complete search history.

(56) References Cited

U.S. PATENT DOCUMENTS

2013/0102445 A1* 4/2013 Henley ..... A24D 3/02 493/47

FOREIGN PATENT DOCUMENTS

| | | | | |
|---|---|---|---|---|
| JP | 06135542 A | * | 5/1994 | ..... A24D 3/0216 |
| WO | WO-2012/089302 A1 | | 7/2012 | |
| WO | WO-2012/089303 A1 | | 7/2012 | |
| WO | WO-2012/089343 A1 | | 7/2012 | |

OTHER PUBLICATIONS

Google English Machine translation of JP 06135542 A (Dec. 26, 2017).*

* cited by examiner

*Primary Examiner* — Anthony Calandra

(74) *Attorney, Agent, or Firm* — Venable LLP; Steven J. Schwarz

(57) ABSTRACT

The present application is directed to an apparatus for inserting objects into a filter rod. The apparatus can include: a first conduit adapted to convey a plurality of the objects in series; a first escapement having a first inlet and a first outlet connected by a first channel, wherein the first inlet is connected to the first conduit; a first singulation drum having an outer periphery defining a first row of first pockets adapted to hold the objects, wherein the first singulation drum is adapted to rotate about a first axis to successively move the first pockets into registry with the first outlet; and at least one first source of air that conveys the objects from the first inlet to the first outlet, and successively into the first pockets of the first singulation drum. Other details and methods of inserting objects into a filter rod are also discussed.

24 Claims, 11 Drawing Sheets

METHOD AND APPARATUS FOR INSERTING ORIENTED OBJECTS INTO A FILTER ROD

TECHNICAL FIELD

This patent application relates generally to equipment and methods for manufacturing tobacco products, such as cigarettes and the like. More specifically, this patent application relates to equipment and methods for dispensing objects into a cigarette filter.

BACKGROUND

For certain types of tobacco products, such as filter cigarettes, it may be desirable to have objects located in the filter. For example, it may be desirable to have capsules, granular objects, powder, fibers, fiber mixtures, or other items located in the filter. These objects may be added in an oriented or non-oriented manner.

Inserting oriented objects into a filter can prevent manufacturing challenges, because known equipment lacks the ability to adequately align the objects with the filter. This is especially true when operating at high speeds. Accordingly, there is a need in the art for improved methods and apparatuses for inserting oriented objects into a filter rod.

SUMMARY

According to an embodiment, the present invention provides an apparatus for inserting objects into a filter rod. The apparatus can comprise a first conduit adapted to convey a plurality of the objects in series; a first escapement having a first inlet and a first outlet connected by a first channel, wherein the first inlet is connected to the first conduit; a first singulation drum having an outer periphery defining a first row of first pockets adapted to hold the objects, wherein the first singulation drum is adapted to rotate about a first axis to successively move the first pockets into registry with the first outlet; and at least one first source of air that conveys the objects from the first inlet to the first outlet, and successively into the first pockets of the first singulation drum.

According to an embodiment, the present invention provides a method for inserting objects into a filter rod. The method can include: receiving a plurality of the objects from a bulk feeder, each of the objects defining an axis of orientation; conveying the plurality of objects in series through a channel; transferring each of the plurality of objects out of the channel and into one of a plurality of pockets located about the periphery of a singulation drum, wherein the singulation drum rotates about an axis of rotation and each of the objects has its axis of orientation substantially aligned with the axis of rotation; and inserting the objects into respective spaces between adjacent filter segments.

According to an embodiment, the present invention provides a method of combining objects with filter rod segments. The method can comprise: receiving a plurality of the objects from a bulk feeder, each of the objects defining an axis of orientation and a surface that is tapered with respect to the axis of orientation by a taper angle; transferring the objects to the periphery of a singulation drum using at least one source of air, wherein the singulation drum rotates about an axis of rotation and each of the plurality of objects has its axis of orientation substantially aligned with the axis of rotation; and combining the objects with filter rod segments.

BRIEF DESCRIPTION OF THE DRAWINGS

The foregoing aspects and other features and advantages of the invention will be apparent from the following drawings.

DETAILED DESCRIPTION

Figure 1:
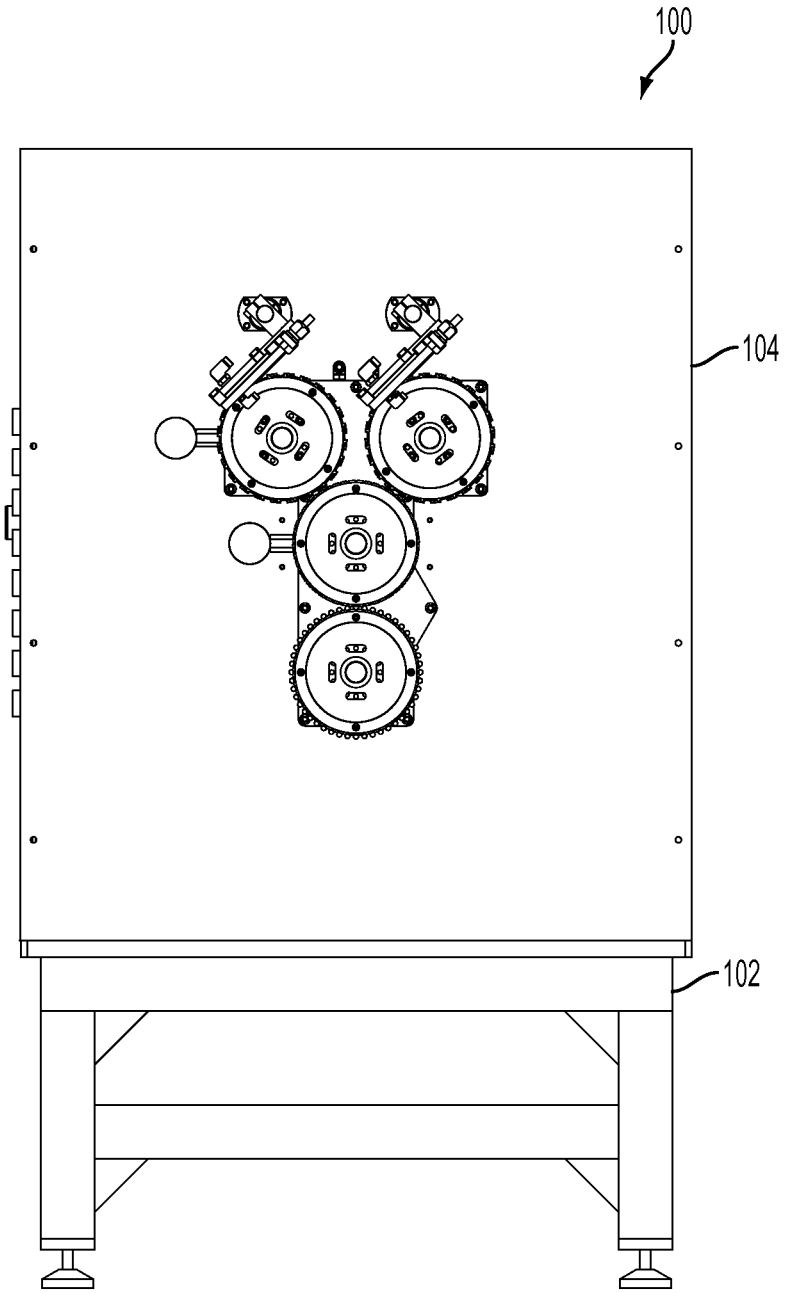
FIG. 1 is a front view of an embodiment of an inserter machine according to the present invention.

Embodiments of the invention are discussed in detail below. In describing embodiments, specific terminology is employed for the sake of clarity. However, the invention is not intended to be limited to the specific terminology so selected. A person skilled in the relevant art will recognize that other equivalent parts can be employed and other methods developed without departing from the spirit and scope of the invention. All references cited herein are incorporated by reference as if each had been individually incorporated.

The present invention relates to apparatuses and methods to insert objects into a component of a smoking article (e.g., cigarettes, cigars, or the like). For example, according to embodiments, principles of the present invention can be used to insert objects into the filter of a smoking article, for example, into the "space" of a "plug-space-plug" arrangement. Alternatively, the apparatuses and methods can be used to insert objects between adjacent tobacco rods, between a tobacco rod and an adjacent filter segment, or between other components of smoking articles, as will be appreciated by one of ordinary skill in the art based on this disclosure.

By way of example, the objects can be beads, flavor capsules, water filled capsules, or pellets, however, other types of objects are also possible. The objects may be used, for example, to enhance the sensory attributes of cigarette smoke. In particular, the objects can be used as vehicles for adding flavor or other substances to the mainstream smoke. Exemplary types of filter material that can be used with the present invention include cellulose acetate tow, gathered cellulose acetate web, polypropylene tow, gathered paper, strands of reconstituted tobacco, and the like.

According to embodiments, apparatuses and methods of the present invention can be used to insert objects into a smoking article at a particular orientation with respect to the longitudinal axis of the smoking article. As used herein, the term "oriented" objects refers to objects (e.g., non-round objects) having a shape that lends itself to a particular alignment with respect to the smoking article. For example, an oriented object may define an orientation axis (e.g., coincident with the central longitudinal axis) that is desirably aligned with the longitudinal axis of the smoking article or filter segment into which the object is inserted. According to particular embodiments, the oriented object can comprise a frustoconical object defining an orientation axis, and the apparatuses and methods disclosed herein can combine the frustoconical object with filter segments such that the orientation axis is substantially aligned with the longitudinal axes of the filter segments. Other examples of oriented objects can include, for example and without limitation, cylinders, cones, prolate spheroids, cubes, cuboids, pyramids, and prisms, and other objects having an orientation axis that lends itself to alignment with the longitudinal axis of a smoking article.

Figure 2:
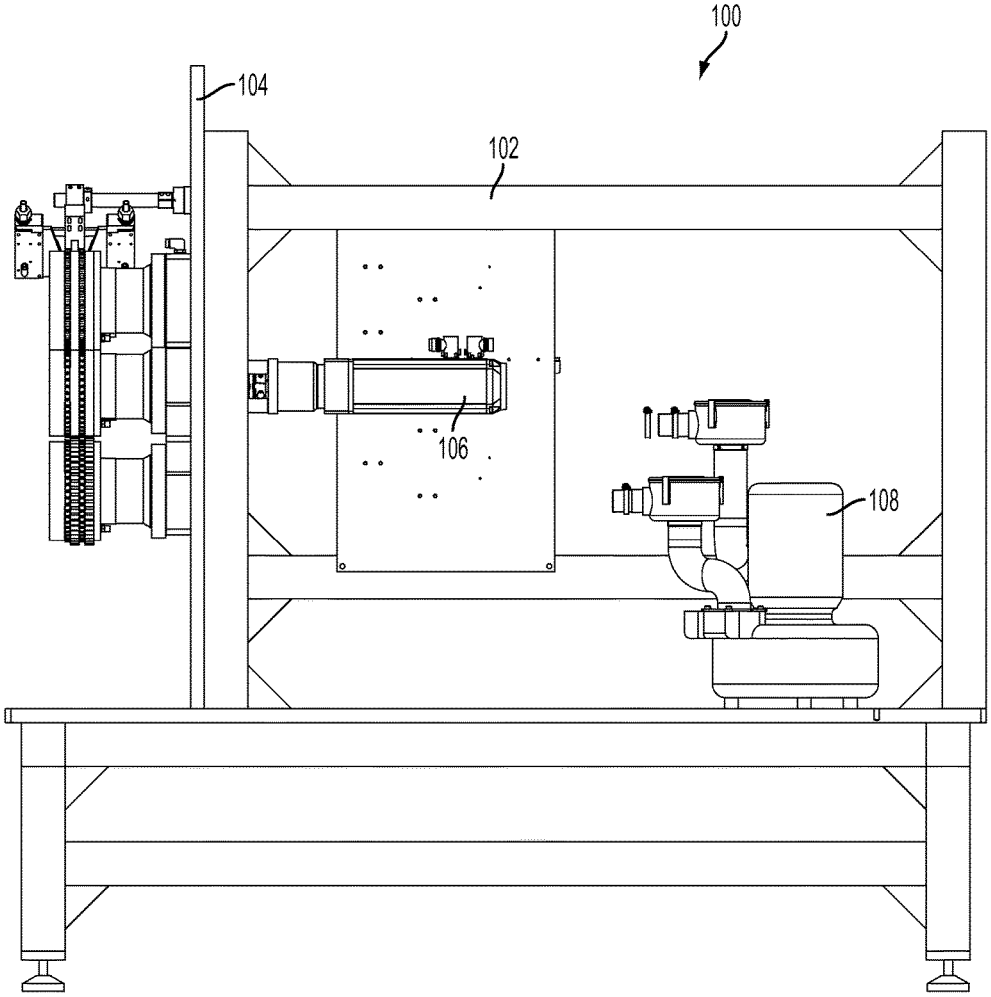
FIG. 2 is a side view of the inserter machine of FIG. 1.
Figure 3:
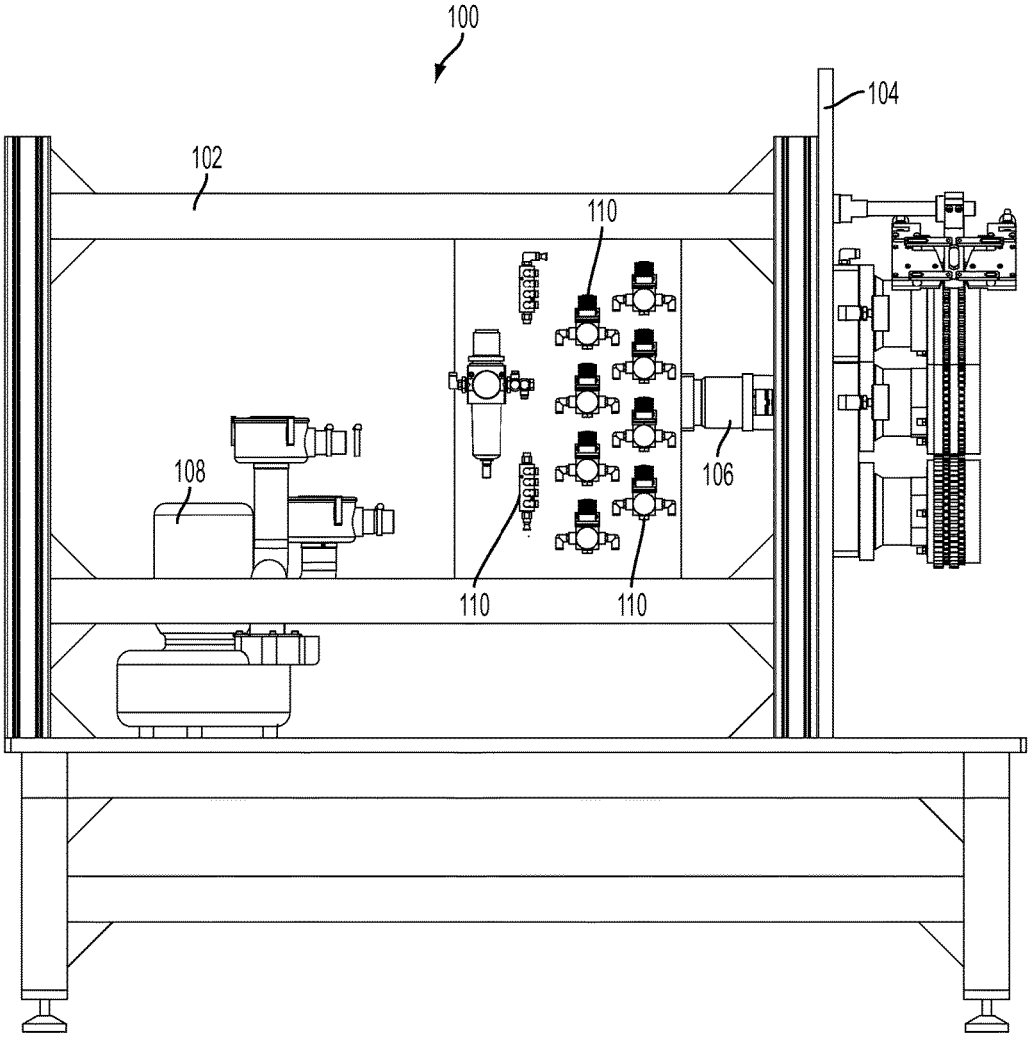
FIG. 3 is an opposite side view of the inserter machine of FIG. 1.

Referring to FIGS. 1, 2, and 3, an embodiment of an object inserter according to the present invention is shown. The inserter 100 can generally include a frame 102 that supports a face plate 104. The frame 102 can have any number of different structures known to one of ordinary skill in the art.

The face plate 104 can have a front surface that supports a plurality of drums and/or other components that act on the tobacco products, as will be discussed in more detail below. Referring to FIG. 2, the face plate 104 can also have a rear surface that supports one or more drive systems 106 that power the drums and/or other components mounted on the front of the face plate 104. More details about the drive system 106 will be provided below. Referring to FIGS. 2 and 3, the frame can further support one or more sources of compressed air 108 (or vacuum), as well as valves 110 or other associated devices.

Figure 4:
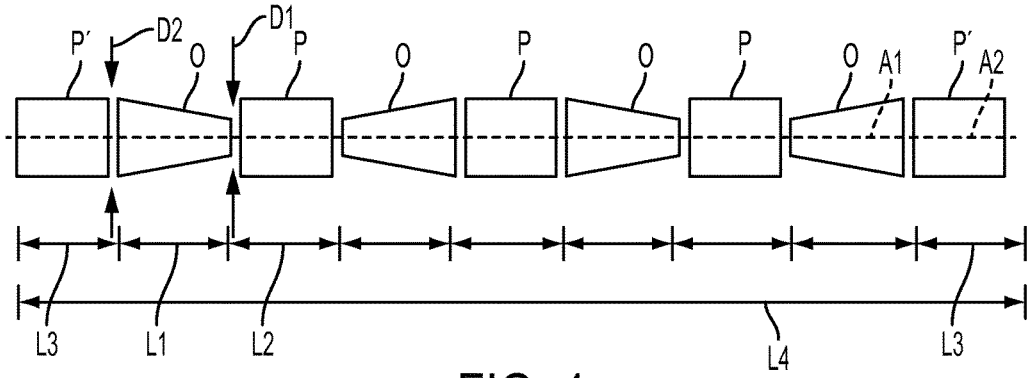
FIG. 4 is a schematic representation of a plurality of objects spaced apart in accordance with embodiments of the present invention.

FIG. 4 depicts a plurality of objects O, in this case frustoconical objects, arranged in an example "plug-space-plug" arrangement, where the "plugs" are filter rod segments P, e.g., cellulose acetate, and the spaces are occupied by the objects O. According to embodiments, each of the objects O can have an axis of orientation Al that extends, for example, along the central longitudinal axis of the object O, thereby making the objects "oriented objects." As also shown, the objects O can be arranged with the filter rod segments P such that the axes of orientation A1 are substantially aligned (e.g., substantially parallel) with the central axes A2 of the filter rod segments P, however, other embodiments are possible.

In the example configuration of FIG. 4, the objects O can define a length L1 of approximately 11 mm, the interior rod segments P can define a length L2 of approximately 16 mm, and the end rod segments P' can define a length L3 of approximately 8 mm, such that the formation (e.g., consisting of four objects O, three interior rod segments P, and two end segments P') defines a total length L4 of approximately 108 mm. However, other dimensions are possible. For example the length L1 of the objects O can range from about 8 mm to about 12 mm or more and the length L2 can range from about 10 mm to about 30 mm or more, depending on the application. Additionally, each of the objects O can define a minor diameter D1 of approximately 5 mm and a major diameter D2 of approximately 6 mm, however, other configurations are possible. For example, the diameter D1 can range from about 3 mm to about 4.5 mm and the diameter D2 can range from about 3 mm to about 10 mm or more, depending on the application. According to embodiments, the difference between D1 and D2 can range from about 0 mm to about 3 mm, for example, 1 mm, however, other dimensions are possible. The length L4 can range from about 60 mm to about 160 mm or more, based on the application. One of ordinary skill in the art will appreciate based on this disclosure that various lengths and diameters can be used for different applications.

Still referring to FIG. 4, the objects O can be arranged in alternating orientations with respect to one on another, e.g., pointing towards one another or pointing away from one another, however other configurations are also possible. For example, in certain embodiments, all objects O can point in the same direction.

Figure 5:
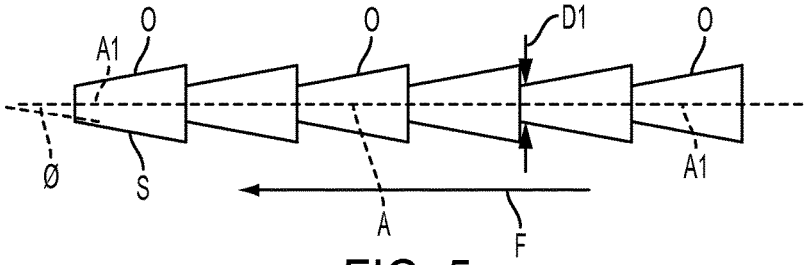
FIG. 5 is a schematic representation of a plurality of objects being fed from a supply, in accordance with embodiments of the present invention.

FIG. 5 depicts a plurality of objects O arranged end-to-end in the same direction, and with their axes of orientation Al substantially aligned. As shown, each object O can define an outer surface S that is tapered with respect to the axis of orientation A1, for example, by a taper angle θ. The taper angle θ can range from about 1 degree to about 5 degrees or more, however, other embodiments are possible.

FIG. 5 depicts an example configuration in which the objects O can be fed from a bulk supply to the inserter machine 100 of the present invention. FIG. 5 depicts the objects O being fed in the direction F, with the minor diameters D1 leading, however, other configurations are possible. According to embodiments, the bulk supply can include one or more hoppers (not depicted) as known to one of ordinary skill in the art. According to embodiments, the hoppers can cumulatively deliver between about 5,000 and about 20,000 objects per minute, or more, however, other configurations are possible.

Figure 6:
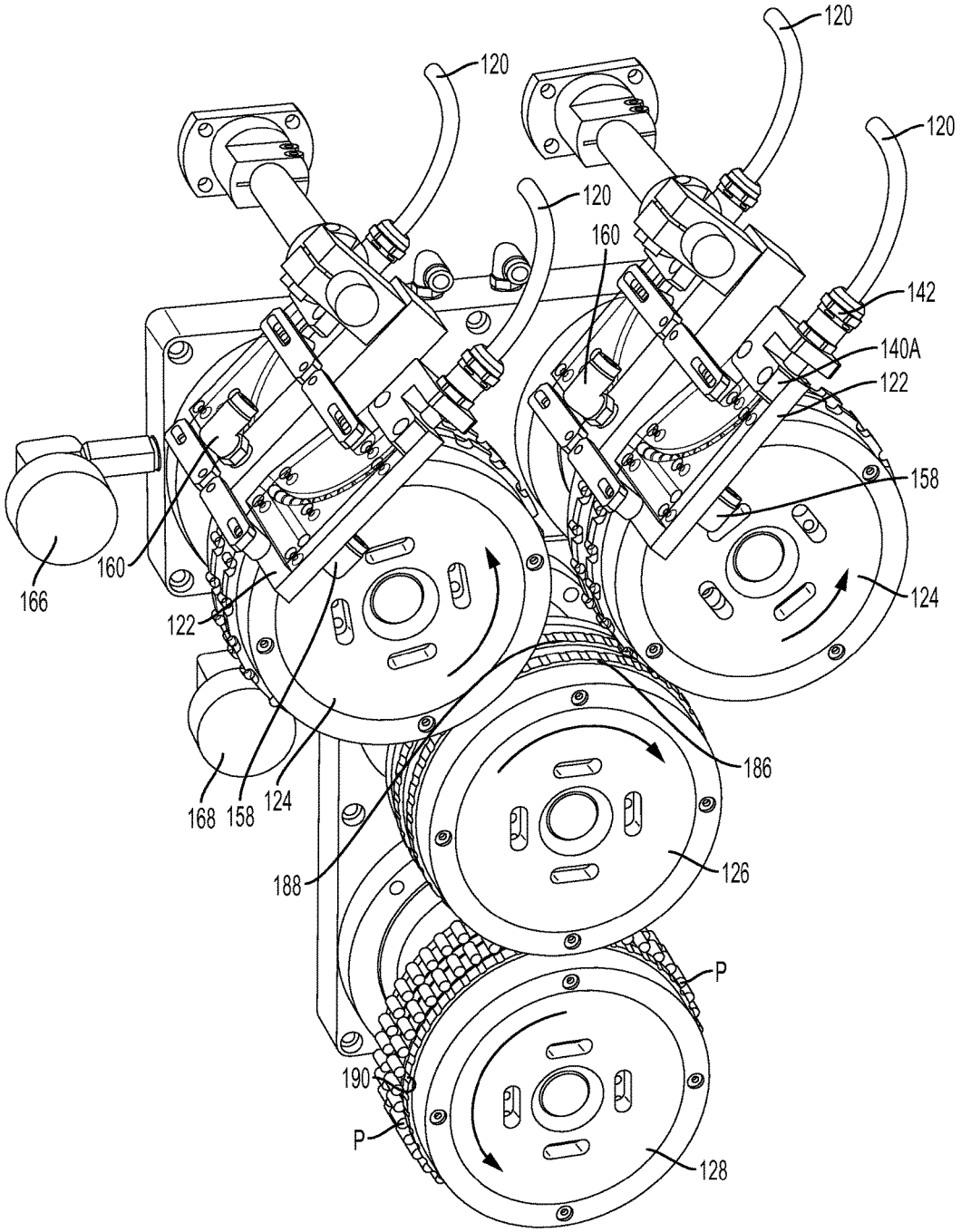
FIG. 6 is a front, perspective view of an embodiment of an escapement and drums from the inserter machine of FIG. 1.
Figure 7:
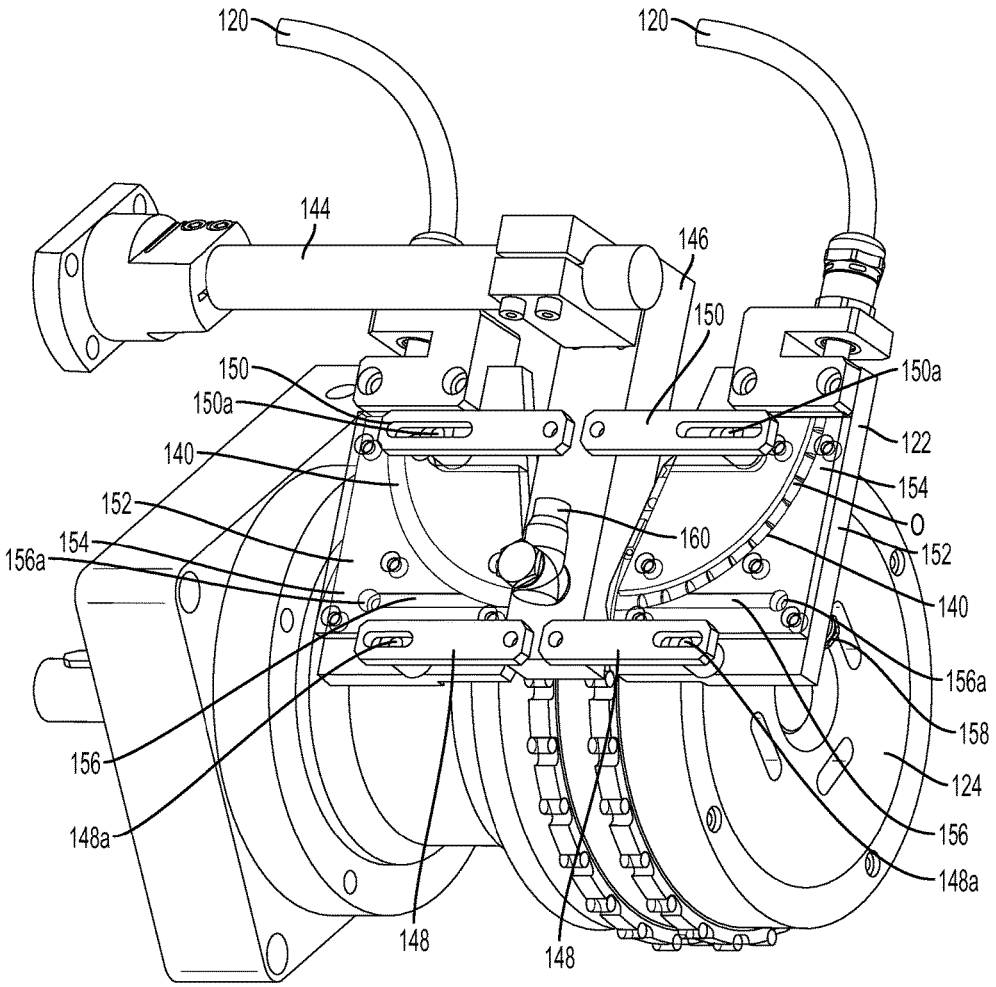
FIG. 7 is a side, perspective view of an embodiment of the escapement from the inserter machine of FIG. 1.

FIGS. 6 and 7 depict the various components that combine the objects O and filter rod segments P. Generally, one or more feed tubes 120 can receive the objects O from the bulk supply and can feed the objects O, for example, in the configuration shown in FIG. 5. As will be discussed in connection with FIG. 8, compressed air can be used to feed the objects O within feed tubes 120, however, other embodiments are possible.

Still referring to FIGS. 6 and 7, each feed tube 120 feeds the objects O to an escapement 122 that orients and delivers the objects O to one or more rotating singulation drums 124. As shown in FIG. 6, the singulation drums 124 can in turn transfer the objects O to one or more rotating combiner drums 126, for example in alternating order, to combine the objects O. The combiner drum(s) 126 can then deliver the objects O to one or more final drums 128, where they are combined with filter rod segments P (or other objects such as tobacco rods) for later processing. According to embodiments, the rotational speed of the foregoing drums can be adjusted to provide an insertion rate of between approximately 2,000 to 4,000 objects per minute (e.g., about 3,000 objects), when measured at each final drum 128. However, this output can be adjusted as needed to suit a particular application, and can be multiplied without adjusting rotating speed by duplicating some or all of the parts described above, as will be understood by one of ordinary skill in the art based on this description.

Figure 8:
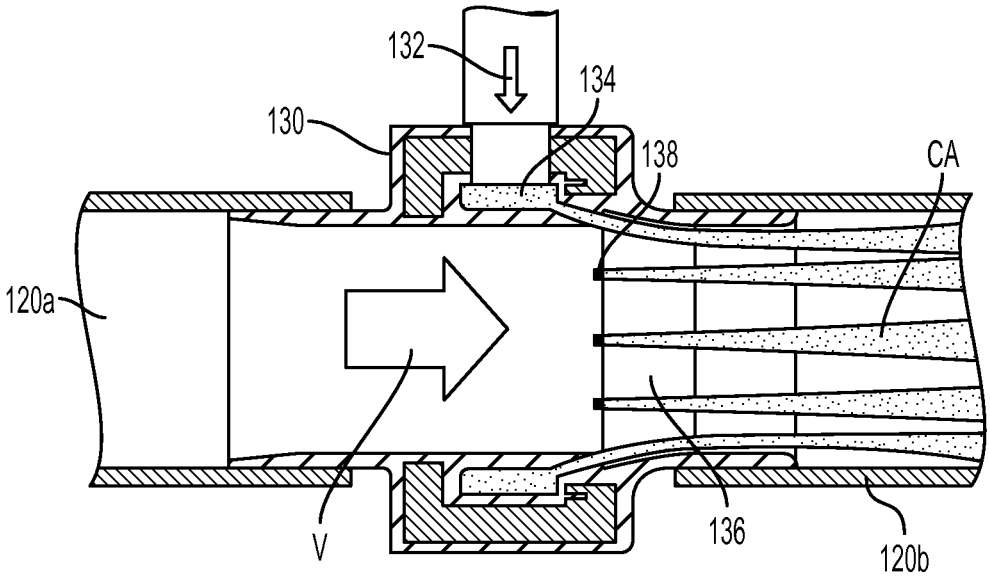
FIG. 8 is a partial cross-sectional view of a plenum according to embodiments of the present invention.

Referring to FIG. 8, the objects O can be fed through the feed tubes 120 under the force of compressed air. For example, each feed tube 120 can have a plenum chamber 130 coupled thereto. Shown in cross-section in FIG. 8, the plenum chamber 130 can have an inlet 132 adapted to connect to a compressed air source (e.g., compressed air source 108 of FIGS. 2, 3). The compressed air can be injected into an annular plenum chamber 134 and then ejected from the plenum throat 136 via a plurality of nozzles 138. Reference CA denotes the compressed air leaving the nozzles 138. The compressed air CA leaving nozzles 138 can create an upstream vacuum V (e.g., at portion 120*a* of the feed tube) that draws the objects in and accelerates them downstream (e.g., through portion 120*b* of the feed tube and beyond). One or more plenum chambers 130 can be associated with each feed tube 120 to supply the objects to the connected escapement 122. One of ordinary skill in the art will appreciate from this disclosure, however, that other configurations can be used to move the objects O through the feed tubes.

Figure 9:
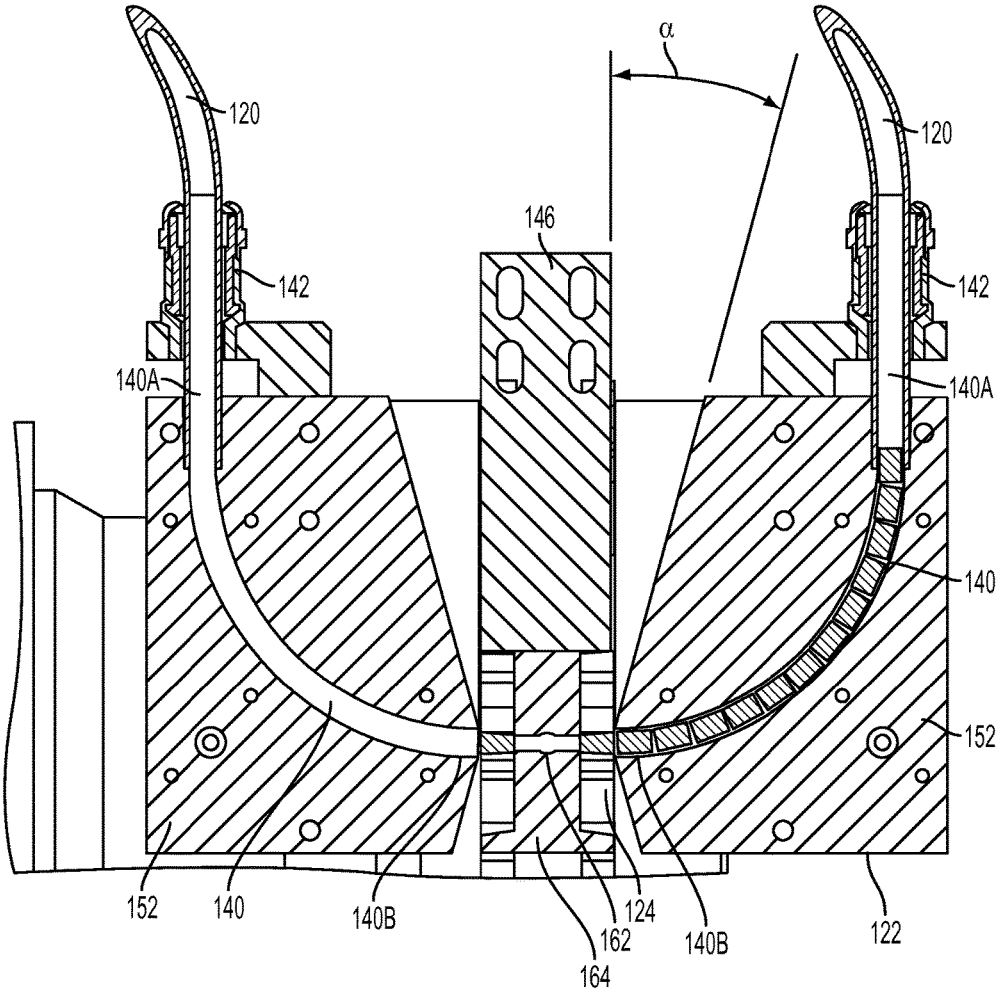
FIG. 9 is a partial cross-sectional view of the escapement of FIG. 7.

Referring to FIGS. 6, 7 and 9, an embodiment of an escapement 122 will be described in more detail. Each escapement 122 can include one or more channels 140 for transporting the objects O serially and in substantial alignment with one another. Each channel 140 can be connected to a feed tube 120. For example, referring to FIGS. 7 and 9, each channel 140 can include in inlet 140A coupled to the respective feed tube 120 through a chord grip 142, however, other couplers and coupling mechanisms are possible. Each channel 140 can also include a downstream outlet 140B (see FIG. 9) that transfers the objects O to the corresponding singulation drum 124.

Referring to FIG. 9, each channel 140 can be curved so that the objects O are fed into the escapements 122 in a direction generally parallel to the singulation drums 124, and are redirected by the channel 140 for transfer from the escapements 122 to the singulation drums in a generally axial direction. For example, each channel 140 can be curved from its inlet 140A to its outlet 140B by an angle ranging from about 60 degrees to about 120 degrees, for example, about 90 degrees. One of ordinary skill in the art will appreciate based on this disclosure, however, that other configurations are possible. According to embodiments, each escapement 122 can include two channels 140, and the outlets 140B of the channels 140 can face one another.

Referring to FIGS. 6 and 9, the escapements 122 can be mounted with respect to the singulation drums 124 via an adjustable mounting system that provides for adjustment of the position and/or attitude of the channel outlets 140B with respect to the respective singulation drums 124. Referring to FIG. 7, the singulation drums 124 and the escapements 122 can both be mounted on the front surface of the face plate 104 (shown in FIG. 1). For example, a mounting arm 144 can extend from the face plate 104, and can support a central support member 146. First and second sets of attachment arms 148, 150 can extend from the support member 146, and can couple to respective first and second plates 152 in which the channels 140 are defined.

Each of the attachment arms can include an elongated slot 148*a*, 150*a* that receives a fastener (not shown) or other member connected to the respective plate 152. By loosening the fasteners and moving them within the respective slots 148*a*, 150*a*, the attitude and/or or lateral spacing of each channel outlet 140B can adjusted with respect to the respective singulation drum 124. This can be done, for example, to properly align the orientation axes of the objects O with the pockets on the singulation drums 124 (to be discussed in more detail below), as well as to adjust the distance the objects O must travel when exiting the channel outlets 140B and entering the singulation drum pockets. According to embodiments, and as shown in FIG. 9, the attitude of the outlets 140B can be adjusted with respect to the singulation drums 124 by an angle α of about 30 degrees, however, other ranges are possible. Moreover, one of ordinary skill in the art will appreciate that other configurations besides the elongated slots and anchors can be used to adjust the position and/or attitude of the plates 152 with respect to the singulation drums 124.

Still referring to FIG. 7, top plates 154 can cover plates 152 to close off the tops of the channels 140. According to embodiments, the top plates can be clear (e.g., clear Lexan) to provide visibility for the objects O moving through the channels 140.

Referring to FIGS. 6-9, one or more air sources can help the objects O move through the channels 140. For example, as shown in FIG. 7, each channel 140 can have an acceleration channel 156 connected thereto, for example, substantially tangentially. Each acceleration channel 156 can have an upstream end 156*a* connected to a source of compressed air, for example by a nozzle 158 best seen in FIG. 6. The compressed air can run along the respective acceleration channel 156 toward the tangential intersection with the respective channel 140, wherein the compressed air accelerates the objects O out of the respective outlet 140A. This can assist transfer of the objects O from the escapements 122 to the singulation drums 124.

Additionally or alternatively, the one or more air sources can comprise a vacuum fitting 160 located between adjacent channel outlets 140B (see FIGS. 6 and 9). The vacuum fitting 160 can have a vacuum port 162 (see FIG. 9) that draws objects O out of the channel outlets 140B and towards pockets in the respective singulation drums 124. For example, as shown in FIG. 9, a stop surface 164 can be located on the support member 146, e.g., between adjacent rows of pockets on the singulation drum 124. The vacuum port 162 can be located in the stop surface 164, and can draw the objects O out of the respective channel outlets 140B and toward the stop surface, facilitating axial movement of the objects into the pockets of the singulation drum 124. According to embodiments, the timing of the compressed air in the acceleration channels 156 and the timing of the vacuum in the vacuum ports 162 can be coordinated to precisely control movement of the objects O from the escapements 122 onto the singulation drums 124. Referring back to FIG. 6, pressure gauges 166, 168 can be provided to measure the pressures in the acceleration channels 156 and vacuum ports 162.

Figure 10:
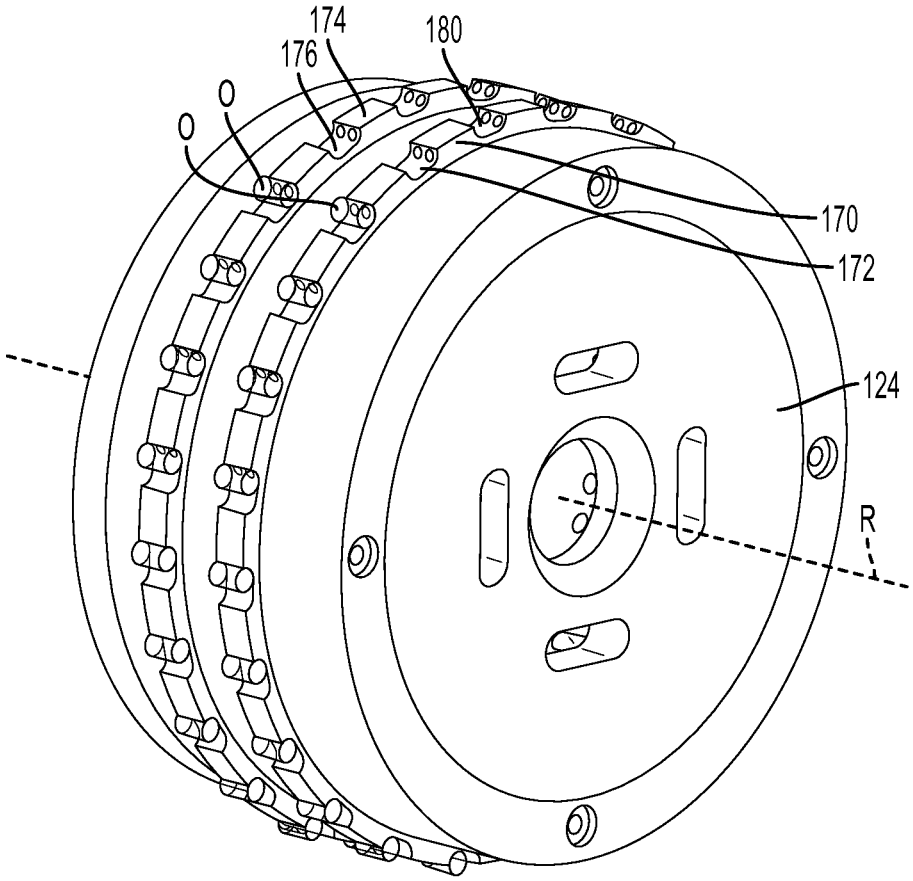
FIG. 10 is a front, perspective view of an embodiment of a drum from the inserter machine of FIG. 1.

Referring to FIG. 10, an embodiment of a singulation drum 124 is shown in more detail. According to embodiments, each singulation drum 124 can have a first row 170 of first pockets 172, and a second row 174 of second pockets 176, however, other quantities of rows are possible. Each of the pockets 172, 176 can be adapted to transport one of the objects O. According to embodiments, a first outlet 140B of an escapement 122 can supply objects O to the first row 170 of first pockets 172, and a second outlet 140B of the same escapement 122 can supply objects O to the second row 174 of second pockets 176, however, other configurations are possible. The rows 170, 174 of pockets 172, 176 can be formed integrally with the singulation drums 124, or alternatively, can be separate parts coupled thereto. According to embodiments, each row of pockets can comprise between about 12 and 36 pockets, for example, 24 pockets, however, other arrangements are possible.

Figure 11A:
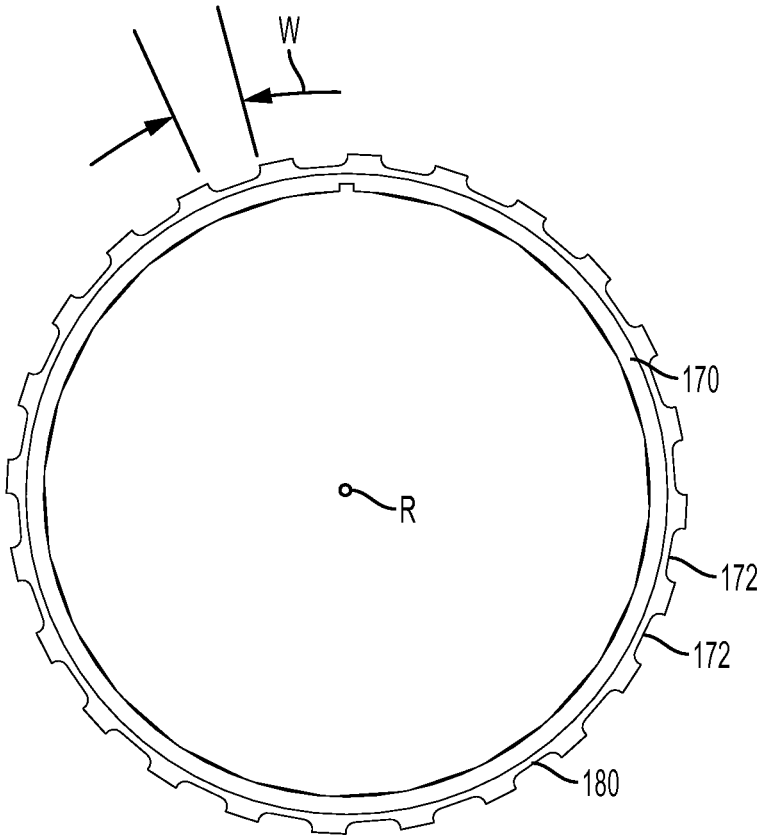
FIGS. 11A and 11B depict front and top views, respectively, of an embodiment of pockets from the inserter machine of FIG. 1.
Figure 11B:
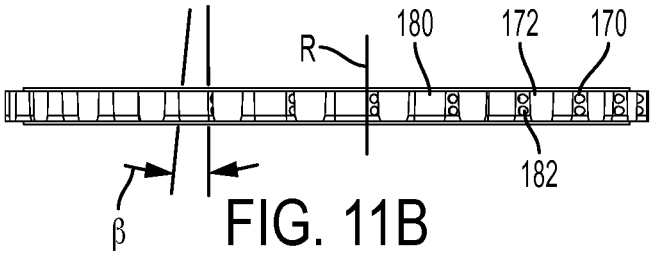

Referring to FIGS. 10, 11A, and 11B, each of the pockets defines a seat 180 adapted to support one of the objects O. The seats 180 can have complimentary geometry to the objects they support, such that the seats 180 can support the objects O with their orientation axes substantially in parallel to the drum's axis of rotation.

Referring to FIG. 11B, at least a portion of the surface of the seat 180 can be tapered with respect to the axis of rotation R of the singulation drum 124 by a seat angle β (see, e.g., FIG. 11B) such that the objects O rest on the seats 180 with their axes of orientation substantially parallel to the axes of rotation R of the singulation drums 124. According to embodiments, the seat angle β can be between about 1 degrees and about 5 degrees, however, other ranges are possible.

Referring to FIG. 11A, each seat 180 can also define a segment width W that extends about the circumference of the singulation drum 124. According to embodiments, each of the objects O can define a largest circumscribed diameter (e.g., the major diameter in the case of a frustoconical object), and the segment width W can be at least about 1.5 times the largest circumscribed diameter. For example, this can comprise a circumferential segment of between about 5 degrees and about 15 degrees, for example, about 10 degrees. This configuration can provide a larger space for the objects O to enter as they pass from the outlets 140B of the respective channels 140, and into the pockets, thereby increasing reliability and reducing capsule breakage. As shown in FIG. 11B, each of the pockets 172, 176 can include flutes 182 connected to a vacuum source (not shown, but see, e.g., air source 108 of FIG. 1). Vacuum can be applied to the flutes 182 slightly before the objects O are transferred to the respective pocket, and the vacuum can be maintained while the object O is in the respective pocket, to maintain the object O in the pocket. When the object O is ready to leave the pocket, e.g., to transfer to a downstream drum, the vacuum can be turned off (or pressurized). A burst of air may be expelled through the pocket after the object O has been transferred, for example, to ensure there is nothing in the empty pocket. The vacuum can be controlled, for example, by control flange technology that applies vacuum to the pockets when in a particular orientation with respect to the control flange, and optionally, applies pressure to the pockets when in another particular orientation with respect to the control flange.

Referring back to FIG. 6, the drums of the inserter 100 can rotate in synchronism with one another under the power of one or more drive systems 106 (see FIG. 2), for example, using a serpentine belt system or other transmission system known in the art. In operation, the singulation drums 124 can rotate counter-clockwise, the combiner drum 126 can rotate clockwise, and the final drum 128 can rotate counter-clockwise, however, other embodiments are possible. As shown in FIG. 6, the combiner drum 126 can include a first row 186 of first combiner pockets and a second row 188 of second combiner pockets. According to embodiments, the combiner pockets can have the same complimentary shape or taper angle as the pockets described above, in order to maintain proper alignment between the objects O and the combiner drum's axis of rotation. In operation, each row of combiner pockets can receive objects O in alternation from the two singulation drums 124. As a result, a pair of singulation drums 124 each having two rows of pockets can supply objects O to two rows of pockets on one combiner drum 126, however, other configurations are possible. Similar to the singulation drums 124, vacuum flutes can be used to maintain the objects O in the pockets of the combiner drum 126.

Figure 12:
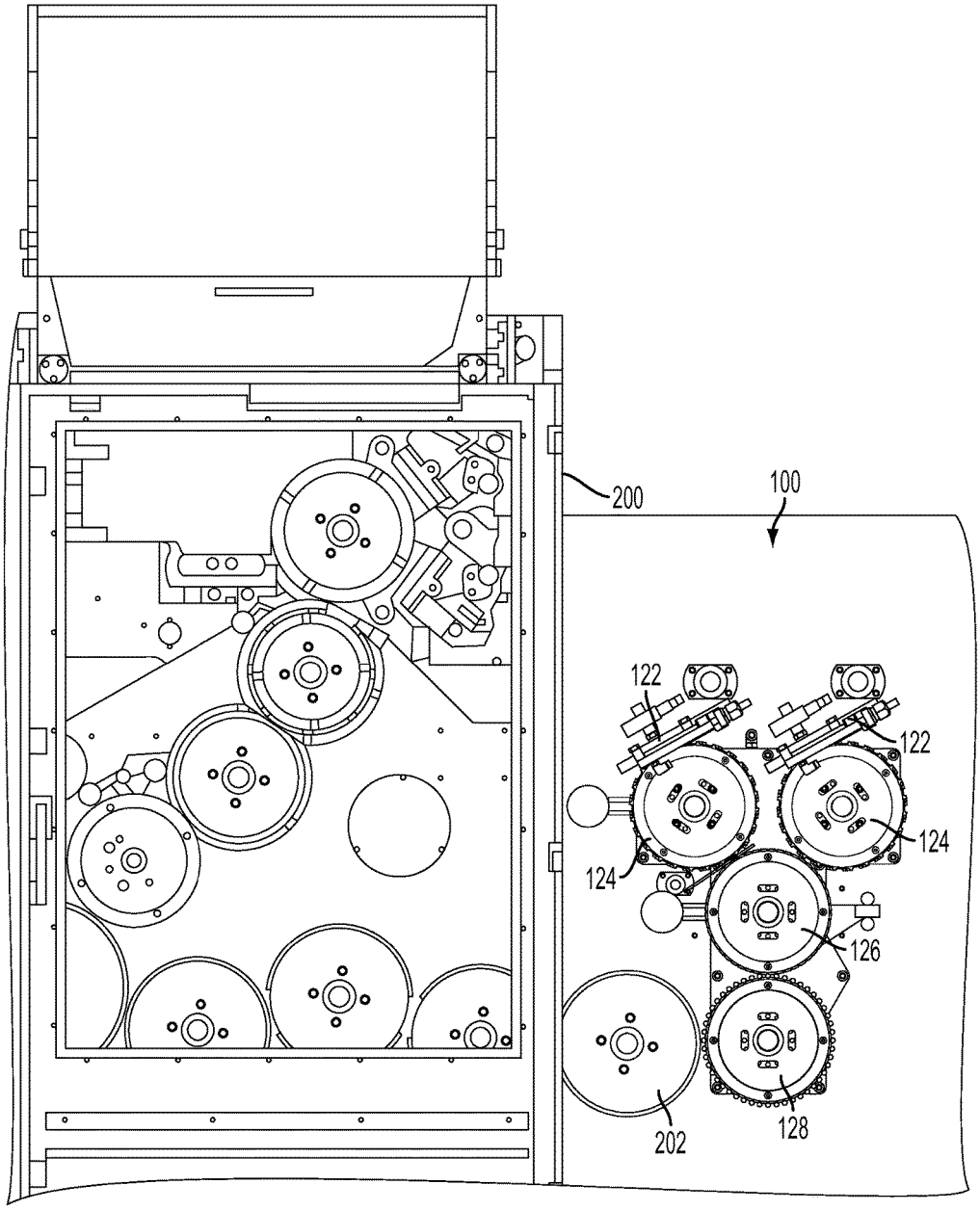
FIG. 12 depicts a front view of the inserter machine of FIG. 1 in combination with a filter maker.

Still referring to FIG. 6, the final drum 128 can have pockets 190 adapted to hold substantially cylindrical objects such as filter segments or tobacco rods (not shown). The final drum 128 can also have tapered pockets adapted to hold the oriented objects O, such that the substantially cylindrical segments P and oriented objects O are aligned end-to-end on the periphery of the final drum 128 and with their axes in substantial alignment (e.g., in parallel). Referring to FIG. 12, the inserter 100 is shown next to a downstream filter maker 200, such as a Hauni KDF machine. The maker 200 can receive the plug-space-plug arrangement from the final drum 128, for example via a transfer drum 202, and can further process the plug-space-plug arrangement into a complete smoking article, or a component thereof. According to embodiments, the process of transferring the objects O from the combiner drum 126 to the final drum 128 can be substantially the same as the transfer of objects from the singulation drum 124 to the combiner drum 126, however, other embodiments are possible.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

The invention claimed is:

1. An apparatus for inserting objects into a filter rod, comprising:

a first conduit adapted to convey a plurality of the objects in series;

a first escapement having a first inlet and a first outlet connected by a first channel, wherein the first inlet is connected to the first conduit;

a first singulation drum having an outer periphery defining a first row of first pockets adapted to hold the objects, wherein the first singulation drum is adapted to rotate about a first axis to successively move the first pockets into registry with the first outlet;

at least one first source of air that conveys the objects from the first inlet to the first outlet, and successively into the first pockets of the first singulation drum;

a second conduit adapted to convey a plurality of the objects in series;

the first escapement having a second inlet and a second outlet connected by a second channel, wherein the second inlet is connected to the second conduit; and a second row of second pockets adapted to hold the objects located on the outer periphery of the first singulation drum, wherein the first singulation drum is adapted to successively move the second pockets into registry with the second outlet;

wherein the at least one source of air conveys the objects from the second inlet to the second outlet, and successively into the second pockets of the first singulation drum.

2. The apparatus of claim 1, wherein the first conduit is connected to a hopper adapted to hold a bulk supply of the objects.

3. The apparatus of claim 1, wherein the first conduit comprises a blow feed tube including a plenum chamber in fluid communication with the blow feed tube, the plenum chamber including a plenum inlet adapted to connect to a compressed air source, and a plurality of outlet nozzles directed along the blow feed tube toward the first escapement.

4. The apparatus of claim 1, wherein the first channel is curved from the first inlet to the first outlet by an angle ranging from about 60 degrees to about 120 degrees.

5. The apparatus of claim 4, wherein the angle is about 90 degrees.

6. The apparatus of claim 1, further comprising:

an adjustable mounting system that supports the first escapement in position with respect to the first singulation drum, the adjustable mounting system adapted to adjust the position and/or attitude of the first outlet with respect to the first pockets on the first singulation drum.

7. The apparatus of claim 1, wherein the at least one source of air comprises:

an acceleration channel that intersects with the first channel upstream of the first outlet; and a compressed air supply coupled to the acceleration channel, the compressed air supply adapted to direct compressed air along the acceleration channel toward the first outlet.

8. The apparatus of claim 7, wherein the acceleration channel intersects the first channel substantially tangentially.

9. The apparatus of claim 1, wherein the at least one source of air comprises:

a vacuum port; and a vacuum supply coupled to the vacuum port;

wherein the first row of first pockets is positioned between the vacuum port and the first outlet of the first escapement.

10. The apparatus of claim 9, further comprising:

a stop surface located opposite the first outlet of the first escapement, the first row of first pockets located between the first outlet and the stop surface;

wherein the vacuum port is located in the stop surface.

11. The apparatus of claim 1, wherein each of the first pockets defines a seat adapted to support one of the objects, and a surface of the seat is tapered with respect to the first axis by a seat angle.

12. The apparatus of claim 11, wherein each of the objects defines an axis of orientation and an outer surface tapered with respect to the axis of orientation by a taper angle, wherein the taper angle substantially compliments the seat angle.

13. The apparatus of claim 12, wherein the seat angle is between about 1 degrees and about 5 degrees.

14. The apparatus of claim 12, wherein the objects are substantially frustoconical.

15. The apparatus of claim 11, wherein the seat defines a segment width extending about the circumference of the first singulation drum, and each of objects defines a largest circumscribed diameter, the segment width being at least about 1.5 times the largest circumscribed diameter.

16. The apparatus of claim 1, further comprising:

a second escapement having a third outlet and a fourth outlet for the objects;

a second singulation drum having a third row of third pockets and a fourth row of fourth pockets, wherein the second singulation drum is adapted to successively move the third and fourth pockets into registry with the third and fourth outlets, respectively; and at least one second source of air that conveys the objects from a third inlet and fourth inlet to the third outlet and fourth outlet, respectively, and successively into the third pockets and fourth pockets of the second singulation drum, respectively.

17. The apparatus of claim 16, further comprising a combiner drum including:

a first row of first combiner pockets aligned with the first row of first pockets and the third row of third pockets; and a second row of second combiner pockets aligned with the second row of second pockets and the fourth row of fourth pockets.

18. The apparatus of claim 17, further comprising a final drum adapted to convey a plurality of filter rod segments, the final drum further adapted to receive the objects from the first row of first combiner pockets and from the second row of second combiner pockets.

19. A method for inserting objects into a filter rod, comprising:

receiving a plurality of the objects from a bulk feeder, each of the objects defining an axis of orientation;

conveying the plurality of objects in series through a channel of the apparatus of claim 1;

transferring each of the plurality of objects out of the channel and into one of the first pockets located about the periphery of the first singulation drum, wherein the first singulation drum rotates about the first axis and each of the objects has its axis of orientation substantially aligned with the first axis; and inserting the objects into respective spaces between adjacent filter segments.

20. The method of claim 19, wherein each of the objects is transferred out of the channel and into one of the first pockets substantially along its axis of orientation.

21. The method of claim 19, wherein:

each of the objects defines an axis of orientation and an outer surface tapered with respect to the axis of orientation by a taper angle; and each of the first pockets defines a seat adapted to support one of the objects, and a surface of the seat is tapered with respect to the first axis by a seat angle that substantially compliments the taper angle.

22. The method of claim 19, wherein inserting the objects into respective spaces between adjacent filter segments comprises:

transferring the objects from the first singulation drum to a combiner drum;

conveying filter segments around the periphery of a rotating final drum, each of the filter segments defining a longitudinal axis; and transferring the objects from the combiner drum to the final drum, wherein the axis of orientation of each object is substantially aligned with the longitudinal axis of at least one of the filter segments.

23. The method of claim 19, wherein the objects are substantially frustoconical.

24. A method of combining objects with filter rod segments, comprising:

receiving a plurality of the objects from a bulk feeder, each of the objects defining an axis of orientation and a surface that is tapered with respect to the axis of orientation by a taper angle;

transferring the objects to the periphery of the first singulation drum of the apparatus of claim 1 using the at least one first source of air, wherein the first singulation drum rotates about the first axis and each of the plurality of objects has its axis of orientation substantially aligned with the first axis; and combining the objects with filter rod segments.

* * * * *